US007798088B2

(12) United States Patent
Hoover et al.

(10) Patent No.: US 7,798,088 B2
(45) Date of Patent: Sep. 21, 2010

(54) PLANING PONTOON TUBE

(75) Inventors: Phillip L. Hoover, Syracuse, IN (US); Terry L. Hoover, Syracuse, IN (US); William G. Price, Goshen, IN (US); Donn R. Huber, New Paris, IN (US)

(73) Assignee: Smoker Craft, Inc., New Paris, IN (US)

( * ) Notice: Subject to any disclaimer, the term of this patent is extended or adjusted under 35 U.S.C. 154(b) by 208 days.

(21) Appl. No.: 12/134,602

(22) Filed: Jun. 6, 2008

(65) Prior Publication Data

US 2009/0301376 A1 Dec. 10, 2009

(51) Int. Cl.
*B63B 1/00* (2006.01)

(52) U.S. Cl. ..... 114/292; 114/356

(58) Field of Classification Search ..... 114/292, 114/356

See application file for complete search history.

(56) References Cited

U.S. PATENT DOCUMENTS

| | | | | |
|---|---|---|---|---|
| 2,251,621 | A | 1/1939 | Van Hoorn | |
| 2,342,023 | A * | 2/1944 | Vidal et al. | 114/357 |
| 2,547,146 | A * | 4/1951 | Anthony | 114/357 |
| 3,303,809 | A | 2/1967 | Ross | |
| 4,193,370 | A | 3/1980 | Schoell | |
| D258,646 | S | 3/1981 | Schwiemann | |
| 4,821,667 | A | 4/1989 | Hargett, Sr. | |
| RE33,359 | E | 10/1990 | Lang | |
| D313,389 | S | 1/1991 | Tragatschnig et al. | |
| 5,184,561 | A | 2/1993 | Nickell, Jr. | |
| D336,887 | S | 6/1993 | Granie et al. | |
| 5,215,025 | A | 6/1993 | Talmor | |
| 5,394,819 | A | 3/1995 | Aarnio | |
| 5,784,977 | A | 7/1998 | Schell et al. | |
| D408,347 | S | 4/1999 | Craddock | |
| 5,911,187 | A | 6/1999 | Sohm | |
| D425,011 | S | 5/2000 | Nakashima et al. | |
| 6,516,736 | B1 | 2/2003 | Van Lancker | |
| 6,898,955 | B1 * | 5/2005 | Davenport | 72/51 |
| D520,935 | S | 5/2006 | Schoell | |
| 7,210,422 | B1 | 5/2007 | Hickok et al. | |

* cited by examiner

*Primary Examiner*—Stephen Avila
(74) *Attorney, Agent, or Firm*—Woodward, Emhardt, Moriarty, McNett and Henry, LLP

(57) ABSTRACT

An improved water tight, chambered planing pontoon assembly incorporates a hollow shell with a cross sectional shape in the form of an upper portion and lower portion. The upper portion of the shape is generally semi-cylindrical extending downward and terminates with opposing chines extending the full length of the tube. The lower portion of the shape is formed by equal and opposing planing surfaces which extend upward at acute angles from a vertical center line, then turn outward, perpendicular to the vertical center line, meeting at the chines. The tube terminates on the bow end with an elongate semi-cone and on the opposite end with a water tight bulkhead. The upper and lower portions of the tube are formed of one homogeneous sheet of metal. The semi-cone with opposing chine portions is formed of one homogeneous sheet of metal.

14 Claims, 10 Drawing Sheets

PLANING PONTOON TUBE

BACKGROUND

Aluminum pontoon assemblies are widely used for recreational watercraft and, to some extent, for aircraft and larger watercraft and for commercial use too. Many are based on cylindrical tubes with a conical shaped termination (typically referred to as a nose cone) at the front end. Efforts to improve the overall performance of such pontoons have resulted in various types of planing surfaces added to the outer surfaces of such pontoons. Some such efforts have improved performance, but with attendant labor and material costs in manufacturing them. Improvement is needed.

DETAILED DESCRIPTION OF THE ILLUSTRATED EMBODIMENT

Figure 1:
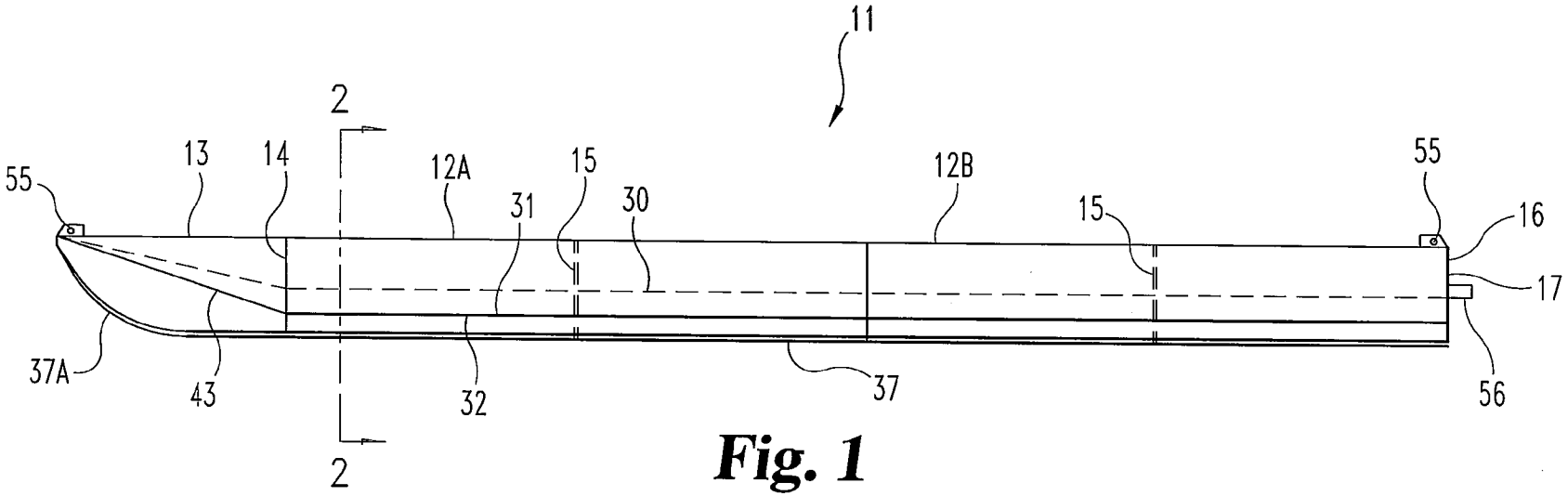
FIG. 1 is a side view of a pontoon assembly incorporating embodiments of the present invention.
Figure 2:
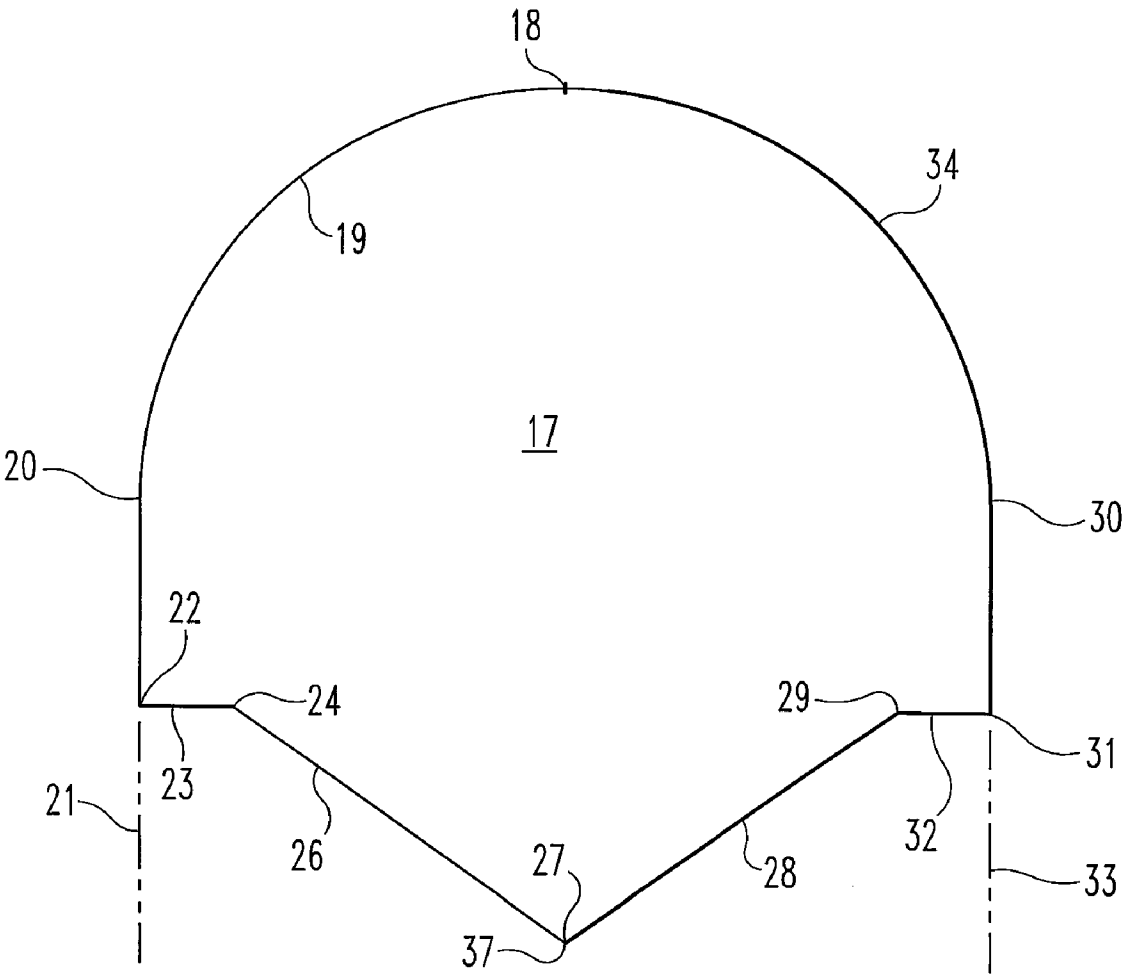
FIG. 2 is an enlarged cross-section of a pontoon tube taken at line 2-2 in FIG. 1 and viewed in the direction of the arrows, but without the mounting brackets of FIG. 3.

Referring now to FIG. 1, the pontoon assembly 11 includes tubes 12A and 12B and a nose cone 13 at the front end 14 of tube 12A. Intermediate bulkheads 15 are provided inside tubes 12A and 12B. At the rear end or stern 16, a terminal bulkhead 17 is secured to close the stern. The cross-sectional shape of the tubes is shown in FIG. 2 and extends from the front end 14 to the rear end 16. Although the illustrated pontoon assembly includes a nose cone and two tubes, the invention can be employed for a pontoon assembly having a nose cone with only one tube, or with as many additional tubes as desired. An inventive feature of these pontoon components is the integration of features of the shapes of the components in the component itself in a single sheet of metal forming the pontoon component.

Referring now to FIG. 2, showing a cross-section as provided in each of the two tubes, numerous features are shown and labeled with reference numerals. The procedure to make this tube begins with a coil of aluminum (5052, 0.080 in., for example) of a width between edges 18, of a dimension selected approximating the circumference or, more specifically the perimeter of the desired cross section of the pontoon to be made from the material. For example, for a pontoon perimeter of about 78 inches, the coil width would be 78 inches. The material is unwound from the coil, flattened, and cut to a length (ten feet for example) according to the length of the tube to be made.

For bending the material, a hydraulic press brake is used. The procedure begins with forming steps in the press brake with a first bend at line 27, followed by a second bend at line 24, followed by a third bend at line 22, thus providing flat surfaces 26, 23 which, in the finished pontoon, form a flat panel 26 serving as a bottom interior running surface of the pontoon, and the adjoining surface 23 which serves as a bottom outer running surface extending laterally to a chine at 22 and longitudinally throughout the length of the tube. And then the sheet with the three bends in it, is turned around and again inserted into the press brake and the bends 29 and 31 are made in it, forming the second bottom interior running surface 28 and second bottom outer running surface 32 extending laterally to a chine at 31 and longitudinally throughout the length of the tube.

Referring now specifically to FIG. 2, and the bend lines at the enumerated reference points shown therein, and as an example, and not a limitation, the bends and included angles inside the bends are as follows:

Bend 1 at line 27, up at 130 degrees.
Bend 2 at line 24, down at 155 degrees.
Bend 3 at line 22, up at 90 degrees.
Bend 4 at line 29, down at 155 degrees.
Bend 5 at line 31, up at 90 degrees.

Following these bends, there are two remaining large flat areas of the material, one in plane 21 and the other in plane 23. The next step is rolling portions of these flat areas on a three-roll sheet metal roller machine. The steps are as follows:

Roll 1—insert edge 18 into the roller to point 20, and roll out through the edge 18.

Roll 2—insert the opposite edge 18 into the roller to point 30, and roll out through the edge 18.

The next step is welding on a seam welder. For the first weld, the tube is inserted into the seamer with the sheet edges overlapping at line 18. Holding that overlap with clamps or otherwise, the overlapping portion is welded together along the line 18 to complete the tube.

It is the additional bends at lines 22, 24, 29 and 31 that are significant in forming the integral outer running surfaces 23 and 32 according to one aspect of the present invention. The angles and outer running surface widths specified have provided excellent results, but some small variations may be useful without departure from the inventive concept.

The tube may be provided in whatever lengths are needed, depending largely on the capacity of the manufacturing machinery available. An example is ten foot lengths. If additional lengths are needed to provide the overall desired length for the pontoon, they can be made in the same way as described above, but with the sheet cut to the length needed to obtain the overall pontoon length desired. The tubes can be welded end-to-end for additional length if and as desired. If the pontoon is to be mounted to the deck of a boat, brackets such as 36 (FIGS. 3 and 3A) or individual brackets spaced longitudinally can be welded to the top of the tube.

Figure 5A:
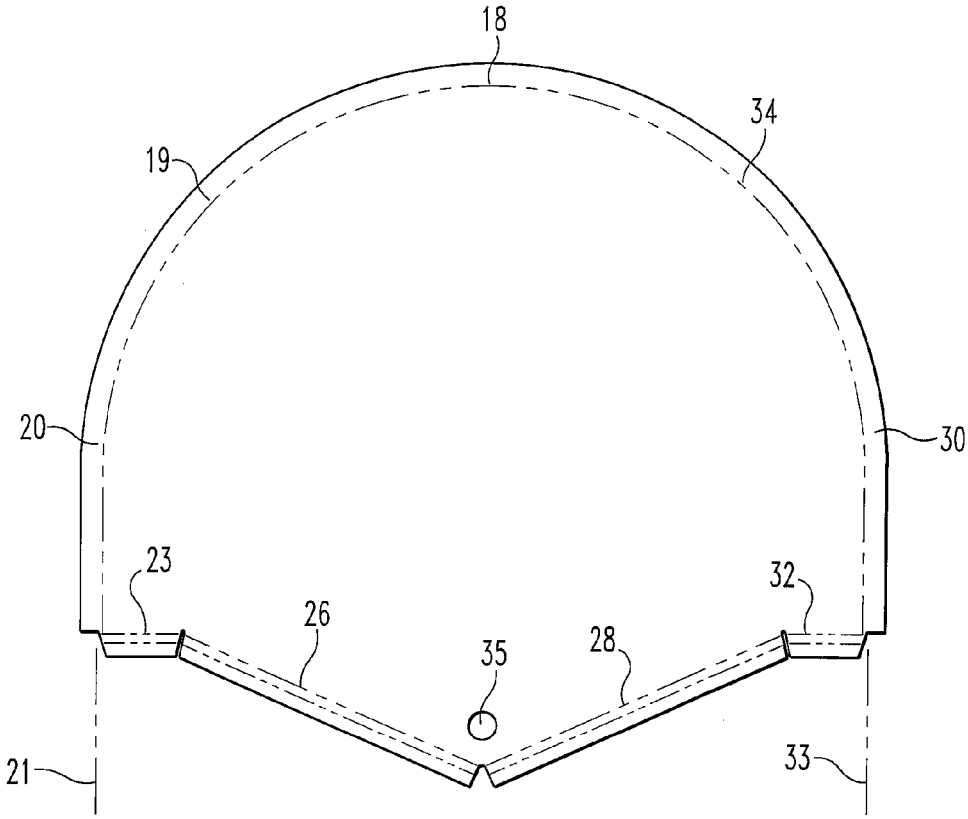
FIG. 5A is a top plan view of the flat sheet blank for the bulkheads before flanging.
Figure 5B:
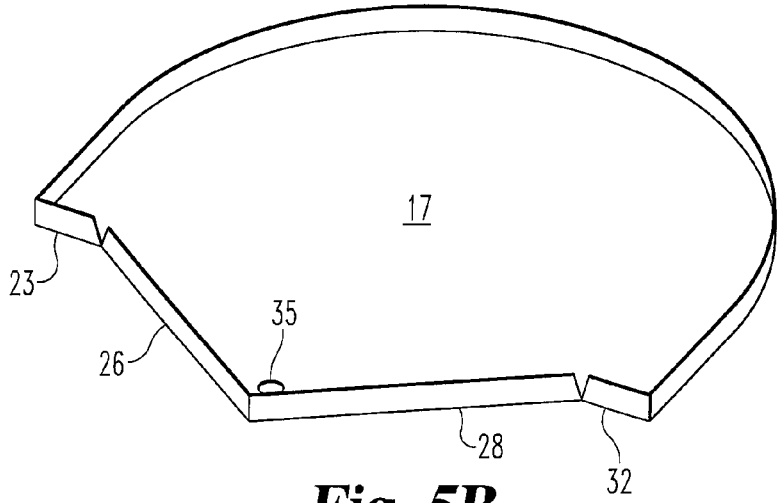
FIG. 5B is an isometric view of the bulkhead blank after flanging.

As mentioned above, there are bulkheads in the assembly at various locations. In the illustrated example there are terminal bulkheads such as 17 at the rear ends of each of the tube sections 12A and 12B. There is also a terminal bulkhead at the rear end of the nose cone. FIG. 5 shows the overall shape of the bulkheads, all of which have the same exterior profile and size. They all have flanges on the perimeter edges which, in FIG. 5A have not yet been turned up. Referring further to FIG. 5A and FIG. 2, the bends are made in the blank of FIG. 5A at the same locations as designated in FIG. 2 and which are designated by the same numbers. To make the blank, material is rolled off the above-mentioned coil, and flattened. Enough is cut off to provide adequate material to cut out of the sheet with a CNC routing machine making the blank of the shape shown in FIG. 5A. Notches are provided to facilitate the forming of the flanges. The round portion from line 21 through areas 20, 19, 18, 34 and 30-33 are flanged on a sheet metal flanger which has a reciprocating die which bends the metal to a given degree based upon the shape of the die. For the remaining portions of the bulkhead, they are done on a hydraulic press brake with bends in the sequence as follows:

Bend 1 at line 23, up at 5 degrees.
Bend 2 at line 32, up at 5 degrees.
Bend 3 at line 26, up at 5 degrees.
Bend 4 at line 28, up at 5 degrees.
Bend 5 at line 23, up at 90 degrees.
Bend 6 at line 32, up at 90 degrees.
Bend 7 at line 26, up at 90 degrees.
Bend 8 at line 28, up at 90 degrees.

All of these bulkheads are essentially the same. The intermediate bulkheads may be notched at the bottom edge under hole 35 for drainage between compartments in the tubes. This notch is not provided in the terminal bulkhead 17 installed at the stern of the tube assembly. In assembly of a tube, the bulkhead flange portions are welded to the interior of the tube. Bulkheads can be used as and where desired for structural enhancement and inhibiting flooding of an entire pontoon assembly in the event of a puncture.

Figure 3:
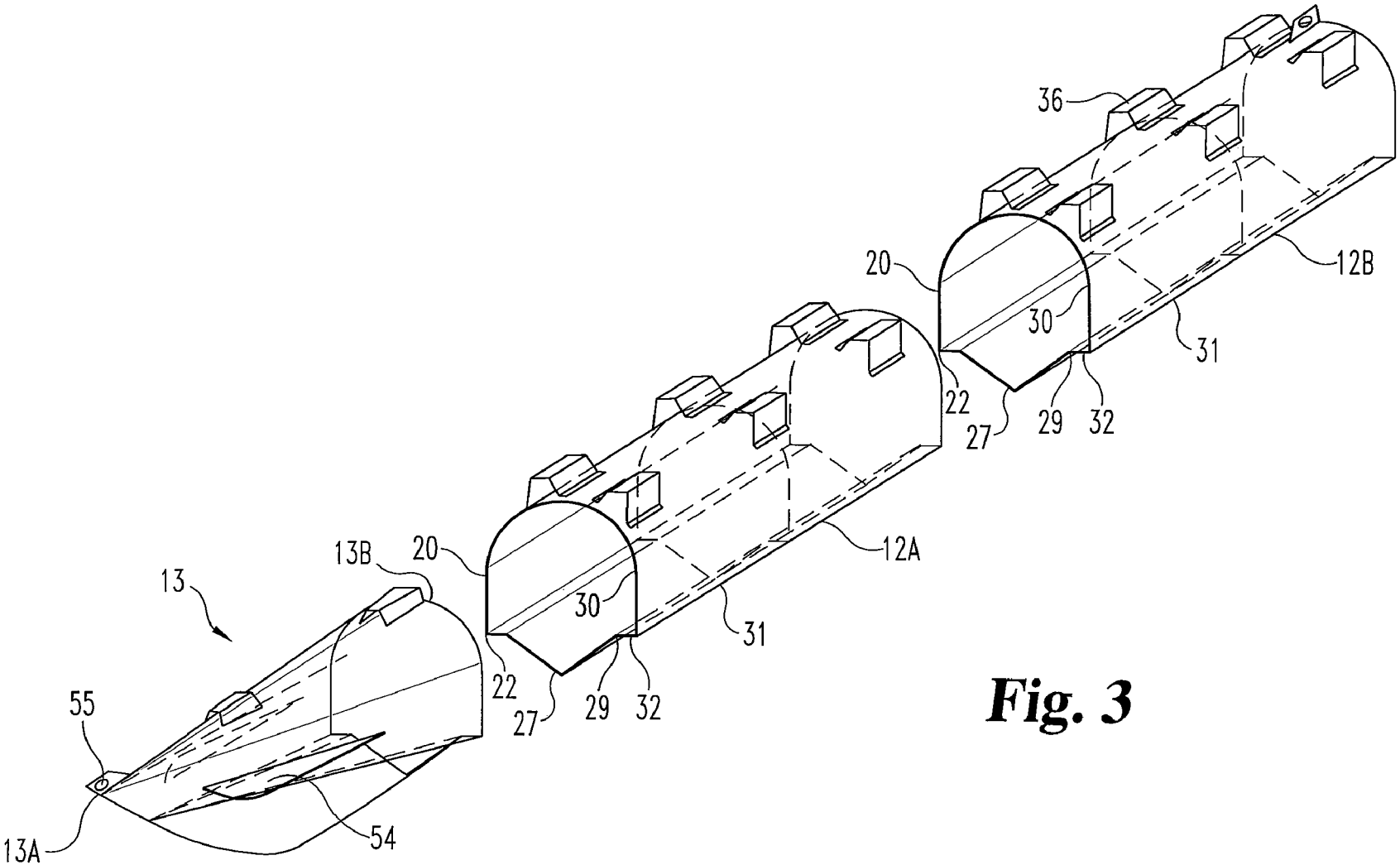
FIG. 3 is an exploded isometric view of the pontoon assembly, with some pontoon-to-boat mounting brackets, deflection fins and lifting lug attached to it.
Figure 4:
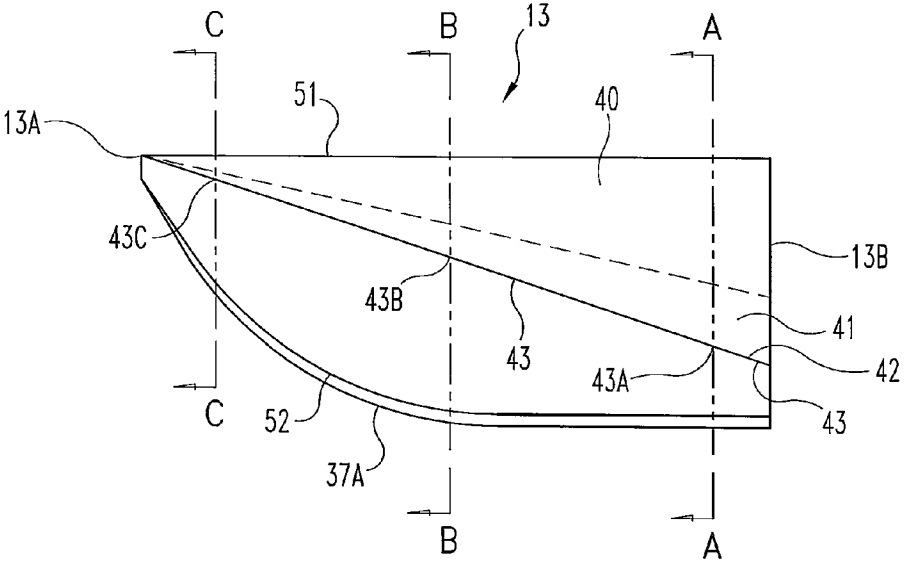
FIG. 4 is a side view of the nose cone portion of the pontoon.
Figure 4B:
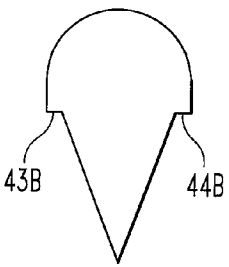
FIG. 4B is a section taken at line B-B in FIG. 4 and viewed in the direction of the arrows.
Figure 4C:
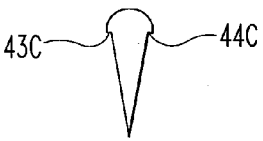
FIG. 4C is a sectional view taken at line C-C in FIG. 4 viewed in the direction of arrows.
Figure 4A:
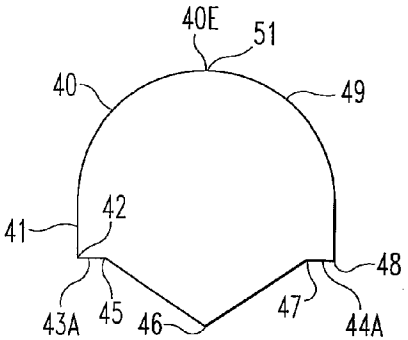
FIG. 4A is a section taken at line A-A in FIG. 4 and viewed in the direction of the arrows.
Figure 6A:
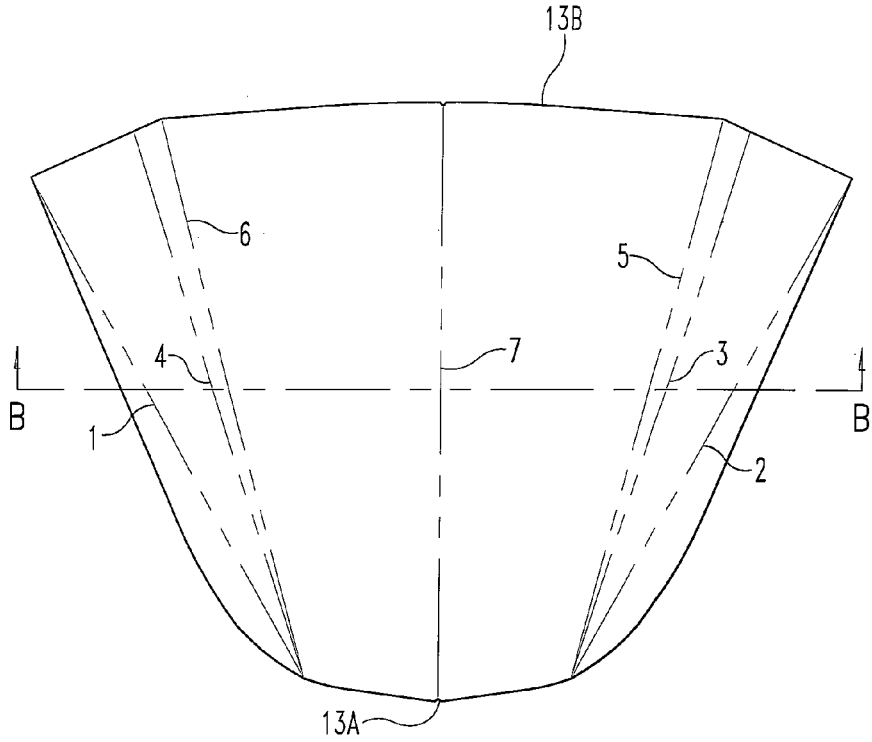
FIG. 6A is a plan view of the flat sheet blank for the nose cone, before forming.
Figure 6B:
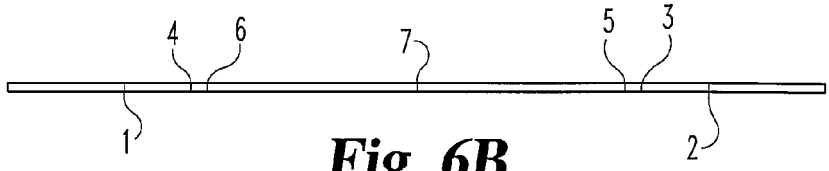
FIG. 6B is a sectional view of the blank at line B-B in FIG. 6A.
Figure 6C:
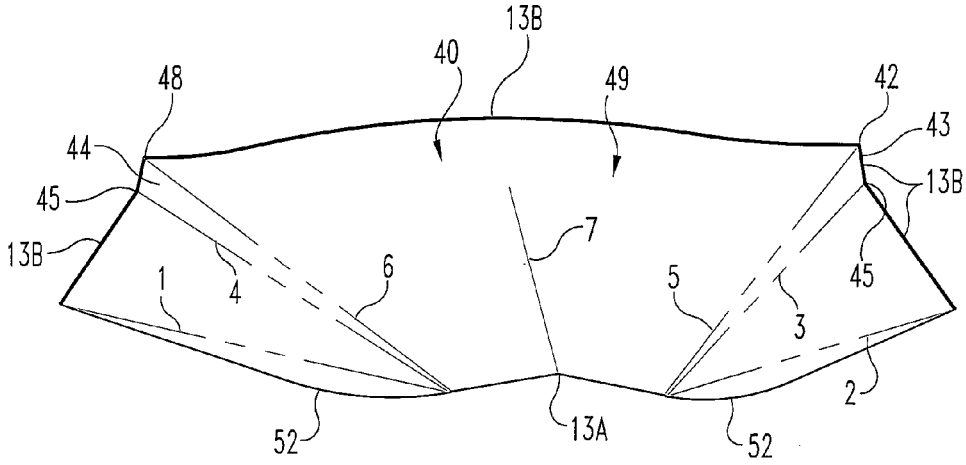
FIG. 6C is a view of the nose cone after press brake forming, before roll forming.

Referring now to FIGS. 3 and 4-4C, the nose cone 13 is started in much the same way as described above for the bulkhead of the pontoon in the sense that material is rolled off the coil, flattened, and cut off to provide enough material to make the needed blank of FIGS. 6A-6C and which is at least as long as is needed for the length of nose cone desired. The blank is cut out using a CNC routing machine.

Referring now to FIGS. 6A-6C, after the blank of FIGS. 6A-6B is cut out by the routing machine, the process to form the nose cone starts with bending at lines 1-7 as follows:

Bend 1 up 10 degrees.
Bend 2 up 10 degrees.
Bend 3 up 60 degrees.
Bend 4 up 60 degrees.
Bend 5 down 60 degrees.
Bend 6 down 60 degrees.
Bend 7 is done on a power bar which is a press brake die of ½" radius and makes a gradual bend on line 7 from 0 degrees at the rear end 13B to 40 degrees down at the front end 13A.

The first six of these bends is done on a press brake; the seventh bend is done with a power bar die mounted on the press brake.

Having made the bends on the press brake, the piece is ready for a rolling function to form the top of the nose cone from the front end 13A to the rounded portion of the rear end 13B of it which is to match the rounded portion of the tube 12A to which the nose cone will be welded.

Figure 7:
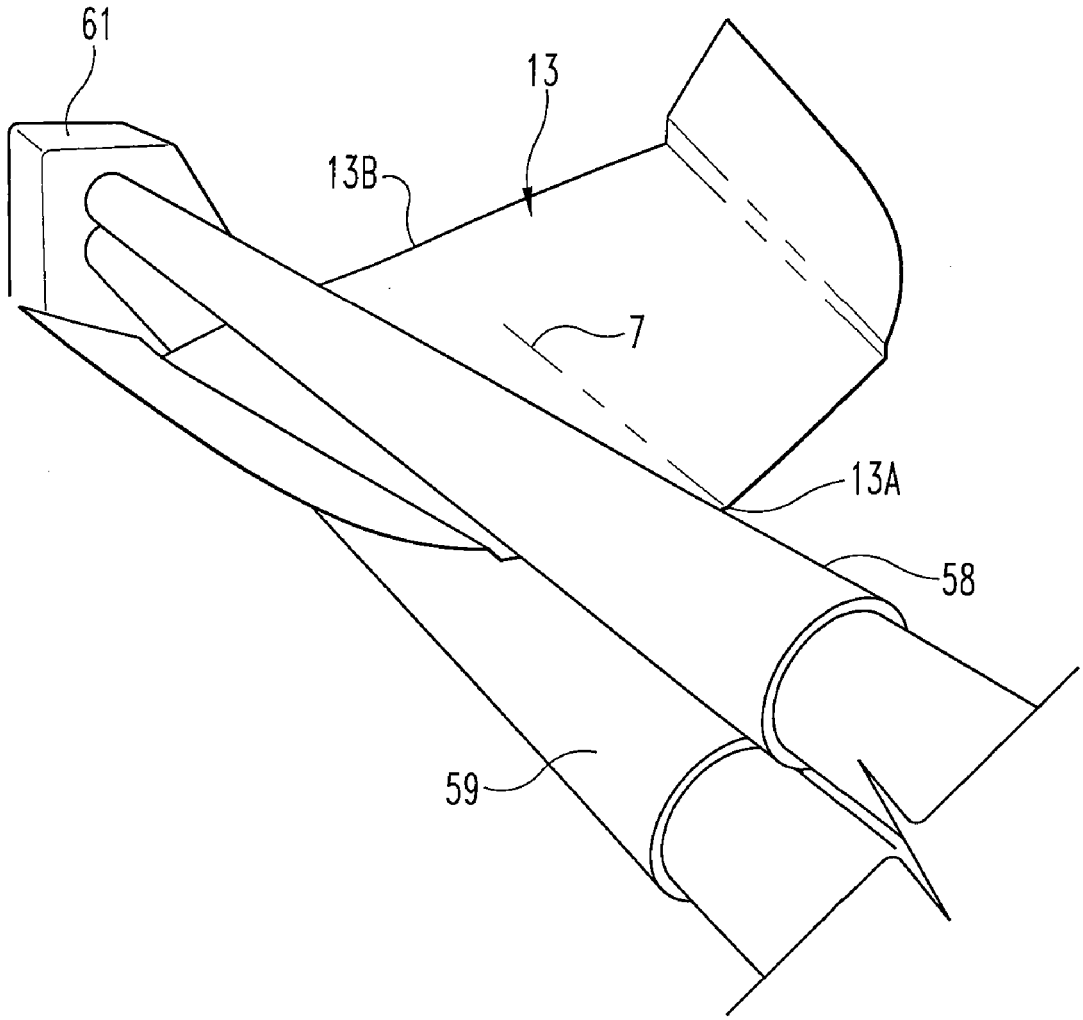
FIG. 7 is a view of the nose cone being formed in a three roll sheet metal roller.

The next step in the formation of the nose cone is the rolling function. Referring now to FIG. 7, the nose cone 13 is shown between two rollers 58 and 59 of a three-roller machine shown only fragmentarily, with the remote ends of the rollers in head 61 at one end of the machine. The third roller in the machine is hidden by the rollers 58 and 59. The part is located with the bend line 5, FIG. 6A near the roller 58. The part is then rolled toward the center line. Then, with the first side formed, the process is repeated on the opposite side.

Figure 8:
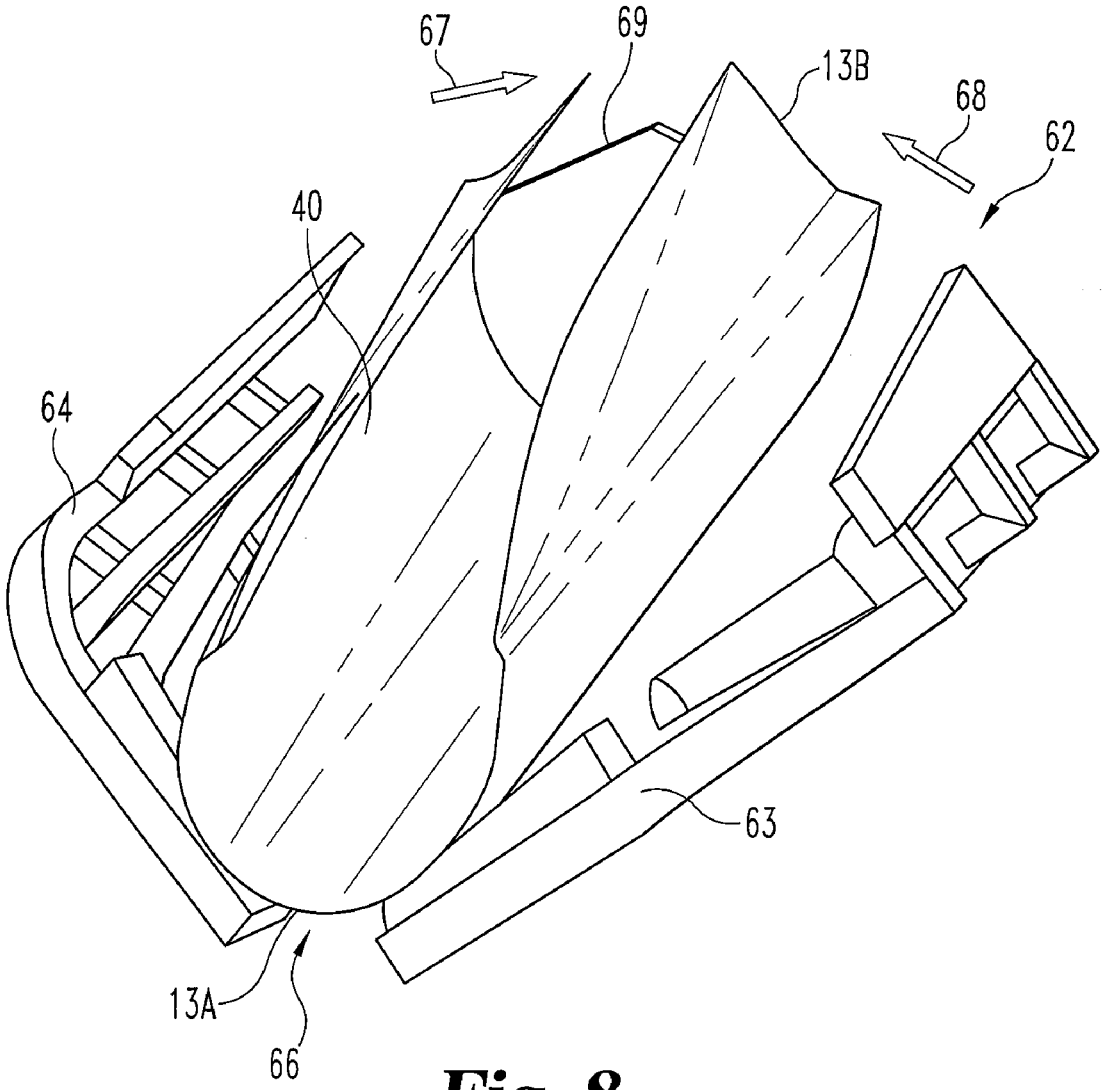
FIG. 8 is a view of the rolled nose cone placed in a hydraulic fixture to complete forming.
Figure 9:
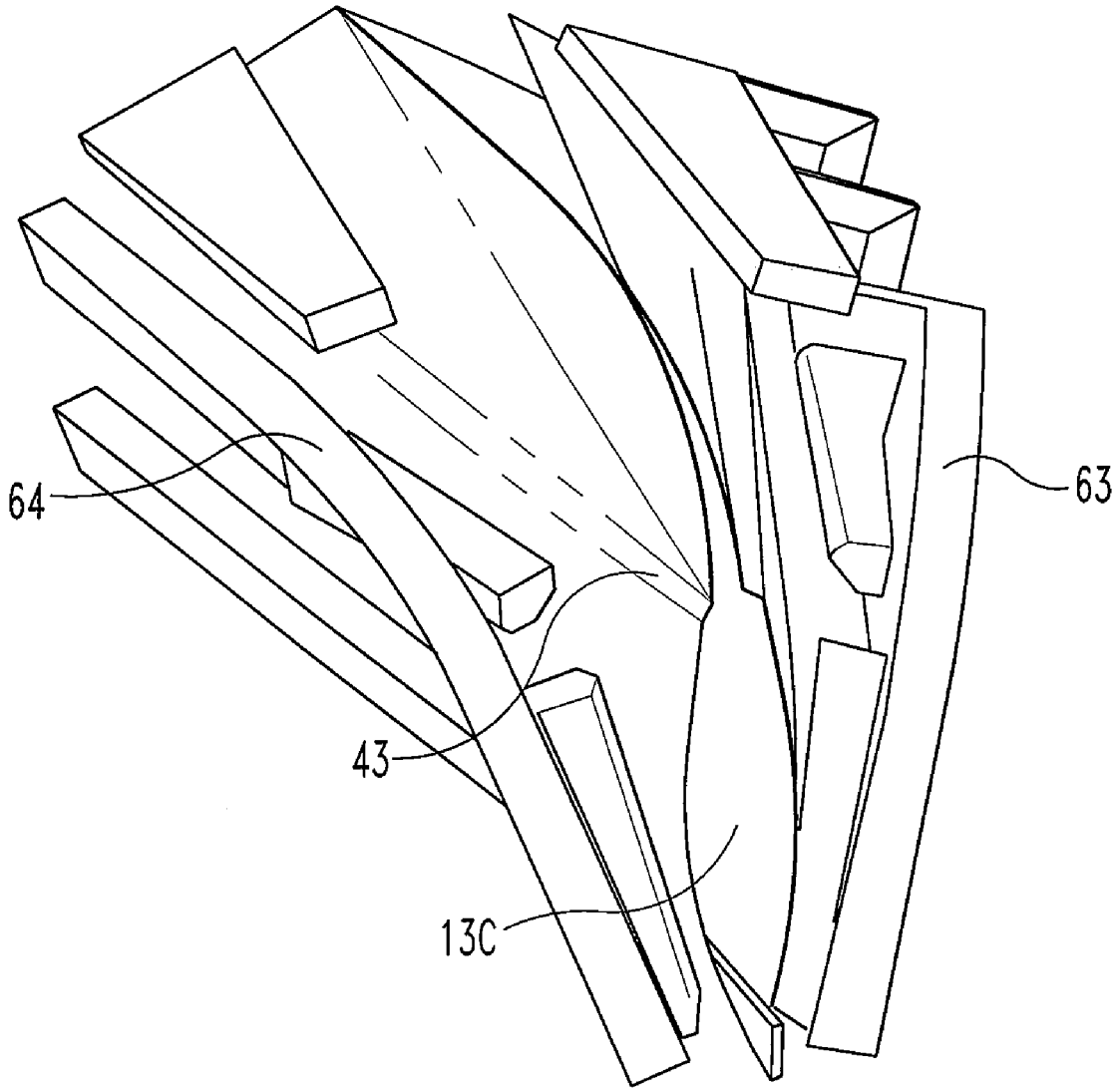
FIG. 9 is a view of the nose cone in the fixture closed forming the final shape.
Figure 10:
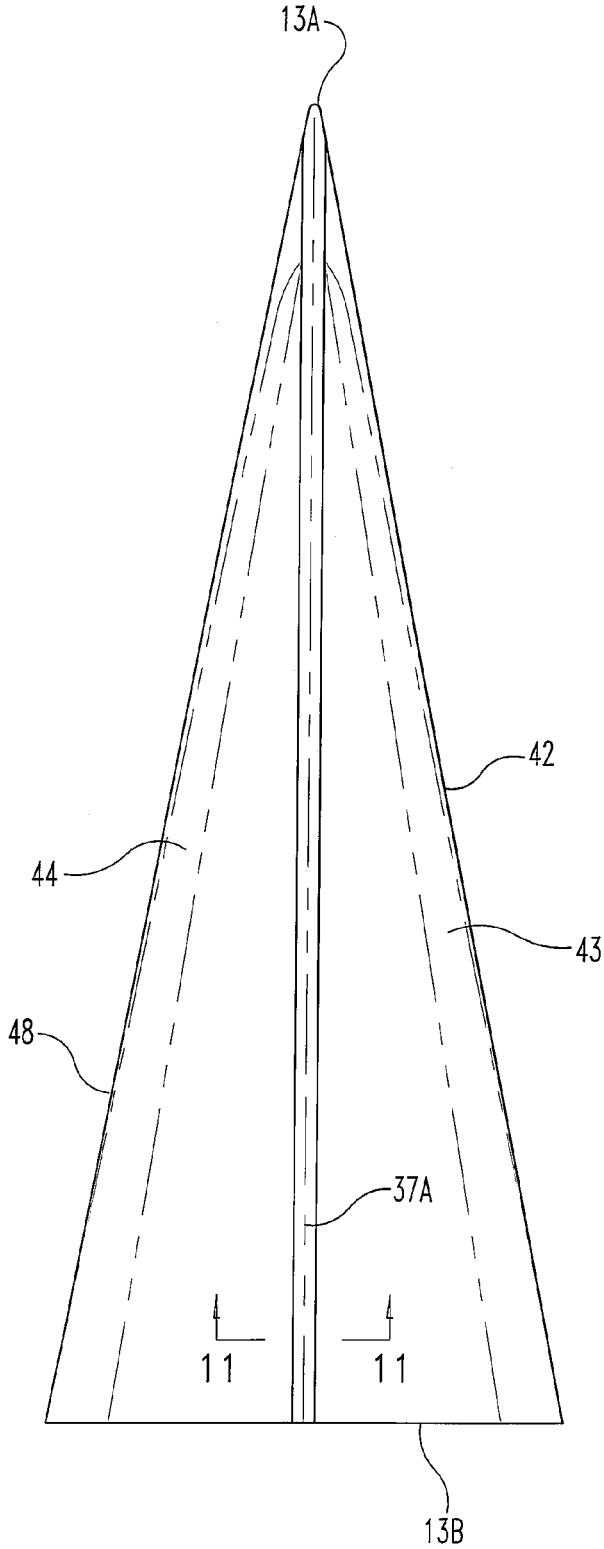
FIG. 10 is a view of the bottom of the finished nose cone with the keel welded in place.
Figure 11:
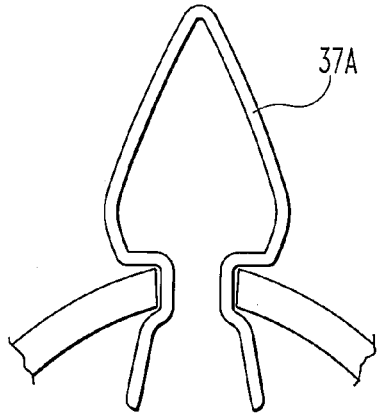
FIG. 11 is enlarged sectional view in the direction of the arrows at line 11-11 in FIG. 10.

Following removal from the rollers, the part is placed in a final forming machine shown generally at 62 in FIG. 8 and has die holders 63 and 64 which are pivotally connected together in the area 66 in order to be moved hydraulically toward each other in the direction of the arrows 67 and 68. An internal die 69 is stationary in the fixture in order that the rear end 13B of the part will have the curved surface thereof maintained during closure of the fixture to the condition shown in FIG. 9, so that the rear end 13B matches the front end of the tube 12A when they are welded together later in assembly of the pontoon. Referring further to FIG. 8, as the jaws of the fixture close as shown by arrows 67 and 68, the various die members mounted to the machine arms 63 and 64 close on the portions of the blank from the curved edge 52, FIG. 6C, to lines 3 and 4 and force those portions toward each other and maintain the integral lifting surfaces 43 and 44 at chines 42 and 48, respectively, as shown in FIGS. 1, 4-4C and 10. Before the fixture 66 is closed completely, a separate piece of material which is an aluminum extrusion 37A having a cross-sectional shape shown in FIG. 11 and previously formed on a separate fixture to the desired curvature of the keel shown at 37A in FIGS. 1 and 4, is placed between the facing curved front edges of the blank. Then, as the clamp closes further, it inserts the curved edges of the blank into the side grooves of the extrusion, closes the portion 13C in FIG. 9, and clamps the extrusion between the curved edges of the blank, thus providing the keel bar 37A for the nose cone. The fixture 66 maintains the closed condition while it is used for the welding step in which the nose cone is held closed by the fixture 66 and welded on both sides of the keel bar from the front end 13A of the nose cone to the rear end 13B.

With the nose cone completed the rear end 13B has a shape perfectly matched to the front end 14 of the tube 12A for welding together. Therefore, the outer running surfaces 32 and 23, as horizontal running surfaces behind the lifting surfaces 43 and 44, respectively, help provide lift as the pontoon moves forward through the water. The lower running surfaces 26 and 28 extending outward from the keel provide vertical lift as well as directional stability as the pontoon is in forward motion. The continuous keel at 27 provides directional stability while in motion, as well as protection against impact and abrasion. For further protection in that area, an aluminum rail 37 may be welded to the outer face of the shell along the length of the keel to serve as a keel bar to provide further protection against impact and abrasion.

The various bend locations, sequences and angles mentioned above have been found to work well, but are given only as examples and not limitations. Similarly, the sequence of assembly of the various parts mentioned into a complete pontoon is normally, but not necessarily, as follows:

1. Internal intermediate bulkheads are welded into each tube section.
2. Terminal bulkheads are welded into each tube section.
3. Tube sections are welded together.
4. The nose cone is welded to the tube 12A.

5. Deflection fins 54 are located on the nose cone using a fixture and welded to the nose cone.
6. The mounting brackets 36 are located, using a fixture, and welded to the tube.
7. The lifting lugs such as 55 at the bow and 56 at the stern (FIG. 1) are welded to the tube.
8. A drain spout opening can be welded at the location 35 in the terminal bulkhead 17 and can be welded in place and internally threaded to receive a threaded plug.
9. At this point the pontoon is complete and ready for testing and, upon successful testing, is ready to be mounted to a boat deck.

What is claimed is:

1. A pontoon comprising:

a nose cone which has a generally pointed front end, and a rear end;

a metal tube which has a front end and a rear end, and said front end of said tube is fastened to said rear end of the nose cone and wherein:

said tube has a cross sectional shape in the form of an upper portion and lower portion, and the upper portion of the shape is semi-circular extending downward and terminates with opposing chines extending the full length of the tube, and the lower portion of the shape has equal and opposing generally planar surfaces which extend upward at acute angles from a vertical center line, then turn outward, perpendicular to said vertical center line, meeting the upper portion at said chines, and said rear end of said nose cone has a cross sectional shape substantially matching the cross sectional shape of the front end of said metal tube, and said nose cone comprises one homogeneous piece of metal from said front end of said nose cone to said rear end of said nose cone, and said nose cone has a keel portion with curved edges from said rear end of said nose cone to said front end of said nose cone, and a keel bar extends upward and forward at said curved edges, and said keel bar has side grooves, and said curved edges are received in said grooves and welded to said keel bar.

2. A method of making a pontoon tube and comprising:

with a blank of material of size needed for a complete tube of the size desired, making a first bend defining a centerline of the blank throughout the length of the blank;

making a second bend along a second line parallel to and spaced from the first line;

making a third bend along a third line parallel to the second line and outboard of the second line;

making a fourth bend parallel to the centerline and spaced from the centerline the same distance as the second bend from the centerline but in a direction from the centerline opposite the direction of the second bend from the centerline;

making a fifth bend along a fifth line parallel to the fourth line and outboard of the fourth line;

from a sixth line parallel to said third line and outboard from said third line, rolling said material outward to one edge of said blank;

rolling said material from a seventh line parallel to said fifth line and outboard from said fifth line, rolling said material outward to an opposite edge of said blank;

whereby concave walls are provided along said opposite edges; and securing said walls together adjacent said edges, to complete a tube.

3. The method of claim 2 and further comprising:

bringing together said walls adjacent said edges; and securing said walls together by welding throughout the length of the tube.

4. The method of claim 2 and wherein:

said first bend provides two adjoining and generally flat surfaces extending longitudinally of the tube and in a V-relationship to provide interior bottom-running surfaces of the tube used as a pontoon;

said second and fourth bends provide two generally flat and generally co-planar surfaces extending longitudinally of the tube outboard of the said adjoining surfaces and provide outer bottom-running surfaces; and said third and fifth bends cooperate with the said generally co-planar surfaces forming chines extending longitudinally of the tube at port and starboard sides of the tube.

5. The method of claim 2 and wherein:

said first bend is up at about 130 degrees;

said second bend is down at about 155 degrees;

said third bend is up at about 90 degrees;

said fourth bend is down at about 155 degrees;

said fifth bend is up at about 90 degrees.

6. The method of claim 3 and further comprising: closing one end of the tube.

7. The method of claim 6 and wherein:

the closing of one end of said tube is by adding a nose cone to said one end.

8. The method of claim 2 and further comprising:

adding to an end of said tube, a second tube made according to the method of claim 2.

9. The method of claim 8 and further comprising:

providing deflection fins on the nose cone.

10. A method of making a pontoon component and comprising:

with a blank of metal of a size needed for a complete component of the size desired, making a shape substantially as shown in FIG. 6A herein;

bending up 10 degrees at about line 1;

bending up 10 degrees at about line 2;

bending up 60 degrees at about line 3;

bending up 60 degrees at about line 4;

bending down 60 degrees at about line 5;

bending down 60 degrees at about line 6;

making a bend along line 7 and which is gradual from zero degrees at the rear end 14B to about forty degrees down at the front end 13A.

11. The method of claim 10 and further comprising:

rolling from about line 5 toward line 7; and rolling from about line 6 toward line 7 to provide a semi-conical surface from said rear end toward said front end.

12. The method of claim 11 and further comprising:

moving curved edges of said blank toward each other;

placing a curved bar between said curved edges; and welding said bar to said edges.

13. The method of claim 12 and further comprising:

placing said edges into elongate grooves in said bar before said welding.

14. The method of claim 11 and further comprising:

closing said rear end of said component with a bulkhead.

* * * * *